US010844499B2

(12) United States Patent
Aziz et al.

(10) Patent No.: US 10,844,499 B2
(45) **Date of Patent: *Nov. 24, 2020**

(54) AQUEOUS SOLUTION METHOD FOR MANUFACTURING PALLADIUM DOPED ELECTRODE

(71) Applicant: KING FAHD UNIVERSITY OF PETROLEUM AND MINERALS, Dhahran (SA)

(72) Inventors: Md. Abdul Aziz, Dhahran (SA); Mohammed Nasiruzzaman Shaikh, Dhahran (SA); Zain Hassan Yamani, Dhahran (SA); Wael Mahfoz, Khobar (SA); Fatai Olawale Bakare, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/192,046

(22) Filed: Nov. 15, 2018

(65) Prior Publication Data

US 2019/0085474 A1 Mar. 21, 2019

Related U.S. Application Data

(63) Continuation of application No. 15/048,560, filed on Feb. 19, 2016, now Pat. No. 10,161,052.

(51) Int. Cl.

| | |
|---|---|
| ***C25D 7/00*** | (2006.01) |
| ***C25D 9/02*** | (2006.01) |
| ***C25D 3/02*** | (2006.01) |
| ***C25B 3/12*** | (2006.01) |
| ***C25B 9/16*** | (2006.01) |
| ***C25B 11/04*** | (2006.01) |
| ***C25B 1/02*** | (2006.01) |
| ***C25B 1/00*** | (2006.01) |
| ***C25B 3/02*** | (2006.01) |
| ***C25B 11/02*** | (2006.01) |

(52) U.S. Cl.

CPC ..... *C25B 11/0473* (2013.01); *C25B 1/00* (2013.01); *C25B 1/02* (2013.01); *C25B 3/02* (2013.01); *C25B 11/02* (2013.01); *C25B 11/0405* (2013.01); *C25B 11/0415* (2013.01)

(58) Field of Classification Search

CPC ... C25D 7/00; C25D 9/02; C25D 3/02; C25D 1/00; C25D 3/12; C25D 9/16

USPC ..... 205/109

See application file for complete search history.

(56) References Cited

U.S. PATENT DOCUMENTS

| | | | | |
|---|---|---|---|---|
| 8,822,814 | B2 | 9/2014 | Hayashi | |
| 2006/0001726 | A1 | 1/2006 | Kodas et al. | |
| 2010/0108240 | A1 | 5/2010 | Wei et al. | |
| 2011/0290003 | A1 | 12/2011 | Liu et al. | |
| 2015/0053554 | A1* | 2/2015 | Kawde | G01N 27/30 204/400 |
| 2015/0249195 | A1 | 9/2015 | Han | |

OTHER PUBLICATIONS

Prabhakar Rai, et al., "Citrate-assisted one-pot assembly of palladium nanoparticles onto ZnO nanorods for CO sensing application", Materials Chemistry and Physics, vol. 142, Issue 2-3, Nov. 15, 2013, 1 page (Abstract only).

Soundappan Thiagarajan, et al., "Palladium nanoparticles modified electrode for the selective detection of catecholamine neurotransmitters in presence of ascorbic acid", Bioelectrochemistry, vol. 75. (2009), pp. 163-169.

Fatai Olawale Bakare, et al., "Preparation and Electrochemical Properties of a Gallium-Doped Zinc Oxide Electrode Decorated with Densely Gathered Palladium Nanoparticles", Journal of The Electrochemical Society. vol. 163, No. 2, (2016), pp. H24-H29.

Paolo Bertoncello, et al., "Formation and evaluation of electrochemically-active ultra-thin palladium-Nafion nanocomposite films", Chem. Commun., Mar. 2007, pp. 1597-1599.

Byung-Kwon Kim, et al., "Electrochemical deposition of Pd nanoparticles on indium-tin oxide electrodes and their catalytic properties for formic acid oxidation", Electrochemistry Communications, vol. 12, (2010), pp. 1442-1445.

Paolo Bertoncello, et al., "Functional electrochemically-active ultra-thin Nafion films", Colloids and Surfaces A: Physicochem. Eng, Aspects, vol. 321, (2008) pp. 222-226.

* cited by examiner

*Primary Examiner* — Zulmariam Mendez

(74) *Attorney, Agent, or Firm* — Oblon, McClelland, Maier & Neustadt, L.L.P.

(57) ABSTRACT

A method for manufacturing a palladium coated doped metal oxide conducting electrode including immersing a metal oxide conducting electrode into an aqueous solution having a palladium precursor salt to form the metal oxide conducting electrode having at least one surface coated with palladium precursor. To form a layer of palladium nanoparticles on the metal oxide conducting electrode the palladium precursor on the metal oxide conducting is reduced with a borohydride compound. The palladium nanoparticles on the metal oxide conducting electrode have an average diameter of 8 nm to 22 nm and are present on the surface of the metal oxide conducting electrode at a density from $1.5\times10^{-3}$ $Pd\cdot nm^{-2}$ to $3.5\times10^{-3}$ $Pd\cdot nm^{-2}$.

16 Claims, 7 Drawing Sheets

AQUEOUS SOLUTION METHOD FOR MANUFACTURING PALLADIUM DOPED ELECTRODE

CROSS-REFERENCE TO RELATED APPLICATION

The present application is a Continuation of Ser. No. 15/048,560, now allowed, having a filing date of Feb. 19, 2016.

BACKGROUND OF THE INVENTION

Technical Field

The present invention relates to a method for preparing a gallium-doped zinc oxide electrode decorated with densely gathered palladium nanoparticles having electrocatalytic applications.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

In recent years, transparent conducting oxides (TCOs) have been used in a variety of optoelectronic devices, including flat panel displays and solar cells due to their good electrical conductivity, high transparency in the visible light region, and stability. See Y. C. Lin, T. Y. Chen, L. C. Wang, and S. Y. Lien, "Comparison of AZO, GZO, and AGZO thin films TCOs applied for a-Si solar cells" Journal of the electrochemical society, 159 (2012) H599-H604, M. Li, C. Kuo, S. Chen, C. Lee, "Optical and electric properties of aluminum-gallium doped zinc oxide for transparent conducting film" Proc. SPIE 7409, Thin Film Solar Technology, 74090W, (2009) doi:10.1117/12.825206, and Z. C. Chang, S. C. Liang, "The microstructure of aging ZnO, AZO, and GZO films" International Journal of Chemical, Nuclear, Materials and Metallurgical Engineering 8 (2014) 422-424, incorporated herein by reference in their entireties. Indium tin oxide (ITO) is the most common TCO electrode material; however, because the indium supply is limited, the development of alternative TCOs is desirable. See M. A. Aziz, M. Sohail, M. Oyama, W. Mahfoz, "Electrochemical investigation of metal oxide conducting electrodes for direct detection of sulfide" *Electroanalysis,* 27 (2015) in press, doi: 10.1002/elan.201400539, M. A. Aziz, T. Selvaraju, H. Yang, "Selective determination of catechol in the presence of hydroquinone at bare indium tin oxide electrodes via peak-potential separation and redox cycling by hydrazine" Electroanalysis 19 (2007) 1543-1546, M. A. Aziz, M. Oyama, Materials for Biomedical Applications, "Trans Tech Publication Inc." (2014) pp. 125-143, M. A. Aziz, S. Patra, H, Yang, "A facile method of achieving low surface coverage of Au nanoparticles on an indium tin oxide electrode and its application to protein detection" Chem. Commun. (2008) 4607-4609, P. Bertoncello, M. Peruffo, P. R. Unwin, "Formation and evaluation of electrochemically-active ultra-thin palladium-Nafion nanocomposite films" Chem. Commun. (2007) 1597-1599, M. A. Aziz, S. Park, S. Jon, H. Yang, "Amperometric immunosensing using an indium tin oxide electrode modified with multi-walled carbon nanotube and poly(ethylene glycol)-silane copolymer" Chem. Commun. (2007) 2610-2612, M. Oyama, Recent nanoarchitecture in metal nanoparticle-modified electrodes for electroanalysis, Analytical Sciences 26 (2010) 1-12, B. Kim, D. Seo, J. Y. Lee, H. Song, J. Kwak, "Electrochemical deposition of Pd nanoparticles on indium-tin oxide electrodes and their catalytic properties for formic acid oxidation" Electrochemistry Communications, 12 (2010) 1442-1445, and S. Hussain, K. Akbar, D. Vikraman, M. A. Shehzad, S. Jung, Y. Seo, J. Jung, "Cu/MoS2/ITO based hybrid structure for catalysis of hydrazine oxidation" RSC Adv. 5 (2015) 15374-15378, each incorporated herein by reference in their entirety. Zinc oxide (ZnO) is a strong alternative candidate, as it is inexpensive, non-toxic, and abundant. The poor electrical conductivity of ZnO has led to the exploration of aluminum-doped ZnO (AZO) and gallium-doped ZnO (GZO) for use in optoelectronic devices.

ITO has been widely used in electrochemical voltammetric studies as a base electrode material onto which metal nanoparticles (NPs) may be deposited. AZO and GZO, on the other hand, have not been examined extensively in voltammetric analysis, due to the poor electrocatalytic properties of AZO and GZO toward many electroactive molecules. Modification of AZO and GZO electrodes with metal NP electrocatalysts has not been explored previously.

PdNPs have raised considerable interest in electrocatalytic applications due to their excellent electrocatalytic properties toward a large number of electroactive molecules. For example, PdNP-modified ITO (PdNP-ITO) electrodes have been used as electrocatalysts in the electrochemical reactions of hydrogen, oxygen, hydrogen peroxide ($H_2O_2$), ascorbic acid, formic acid, alcohol, nitrite ions, cefotaxime, and hydrazine. See P. Bertoncello, M. Peruffo, P. R. Unwin, "Functional electrochemically-active ultra-thin Nation films" Colloids and Surfaces A: Physicochem. Eng. Aspects 321 (2008) 222-226, G. Chang, M. Oyama, K. Hirao, "Seed-mediated growth of palladium nanocrystals on indium tin oxide surfaces and their applicability as modified electrodes" J. Phys. Chem. B 110 (2006) 20362-20368, H. Ma, Z. Zhang, H. Pang, S. Li, Y. Chen, W. Zhang, "Fabrication and electrochemical sensing property of a composite film based on a polyoxometalate and palladium nanoparticles" Electrochimica Acta 69 (2012) 379-383, C. Fang, Y. Fan, J. M. Kong, G. J. Zhang, L. Linn, S. Rafeah, "DNA-templated preparation of palladium nanoparticles and their application" Sensors and Actuators B 126 (2007) 684-690, D. Renard, C. McCain, B. Baidoun, A. Bondy, K. Bandyopadhyay, "Electrocatalytic properties of in situ-generated palladium nanoparticle assemblies towards oxidation of multi-carbon alcohols and polyalcohols" Colloids and Surfaces A: Physicochem. Eng. Aspects 463 (2014) 44-54, G. Yang, Y. Yang, Y. Wang, L. Yu, D. Zhou, J. Jia, "Controlled electrochemical behavior of indium tin oxide electrode modified with Pd nanoparticles via electrospinning followed by calcination toward nitrite ions" Electrochimica Acta 78 (2012) 200-204, S. Gupta, R, Prakash, "Ninety Second Electrosynthesis of palladium nanocubes on ITO surface and its application in electrosensing of cefotaxime" Electroanalysis 26 (2014) 2337-2341, and H. Lin, J. Yang, J. Liu, Y. Huang, J. Xiao, X. Zhang, "Properties of Pd nanoparticles-embedded polyaniline multilayer film and its electrocatalytic activity for hydrazine oxidation" Electrochimica Acta 90 (2013) 382-392, each incorporated herein by reference in their entirety.

Previous studies have examined PdNP-modified ITO electrodes in which the modification proceeded through seed-mediated growth. See A. Sangwan, A. Sangwan, M.

Yadav, N. Sehrawat, "Seed-mediated growth of palladium nanocrystals on ITO substrate and their characterization" Adv. Appl. Sci. Res. 4 (2013) 138-145, incorporated herein by reference in its entirety. Because small seed PdNPs attach readily onto ITO surfaces, chemical growth treatments can form PdNP-ITO. The seed-mediated growth method requires longer times and multiple chemicals. The electron transfer reactions can be affected by the molecules which are used to functionalize the electrode surface for capturing the Pd precursors. PdNP-ITO has been prepared by electrospinning a Pd precursor, followed by calcination at high temperatures (500° C.) for two hours. Electrodeposition is commonly used to rapidly prepare PdNP-ITOs at room temperature without functionalizing the ITO surfaces. See S. Thiagarajan, R. Yang, S. Chen, "Palladium nanoparticles modified electrode for the selective detection of catecholamine neurotransmitters in presence of ascorbic acid" Bioelectrochemistry 75 (2009) 163-169, Y. Fang, S. Guo, C. Zhu, S. Dong, E. Wang, "Twenty second synthesis of Pd nanourchins with high electrochemical activity through an electrochemical route" Langmuir 26 (2010) 17816-17820, O. I. Kuntyi, P. Y. Stakhira, V. V. Cherpak, O. I. Bilan, Y. V. Okhremchuk, L. Y. Voznyak, N. V. Kostiv, B. Y. Kulyk, Z. Y. Hotra, "Electrochemical depositions of palladium on indium tin oxide-coated glass and their possible application in organic electronics technology" Micro & Nano Letters 6 (2011) 592-595, and V. I. Pokhmurskii, O. I. Kuntyi, S. A. Kornii, O. I. Bilan, E. V. Okhermchuk, "Formation of palladium nanoparticles under pulse current in a dimethylformamide solution" Protection of Metals and Physical Chemistry of Surfaces 47 (2011) 59-62, each incorporated herein by reference in their entirety. The control of NP size and the achievement of a homogeneous distribution of metal NPs across the substrate surface pose challenges in electrodeposition.

In view of the forgoing, one objective of the present invention is to provide a rapid, simple, cost effective, and reliable method for preparing PdNP densely gathered on GZO electrodes which are capable of electrocatalysis of oxidation reactions.

BRIEF SUMMARY OF THE INVENTION

According to a first aspect, the present disclosure provides a method for manufacturing a palladium doped metal oxide conducting electrode including immersing a metal oxide conducting electrode into an aqueous solution comprising a palladium precursor salt to form the metal oxide conducting electrode having at least one surface coated with palladium precursor, and reducing the metal oxide conducting electrode having at least one surface coated with palladium precursor with a borohydride compound to form the metal oxide conducting electrode having at least one surface coated with palladium nanoparticles, wherein the palladium nanoparticles on the metal oxide conducting electrode have an average diameter of 8 nm to 22 nm and are present on the surface of the metal oxide conducting electrode at a density from $1.5\times10^{-3}$ Pd·nm$^{-2}$ to $3.5\times10^{-3}$ Pd·nm$^{-2}$.

In some implementations of the method, the metal oxide conducting electrode comprises gallium-doped zinc oxide or aluminum-doped zinc oxide.

In some implementations of the method, the palladium precursor salt is selected from the group consisting of potassium tetrachloropalladate (II) or sodium tetrachloropalladate (II).

In some implementations of the method, the aqueous solution comprising the palladium precursor salt has a pH of 2.5-5.

In some implementations of the method, the concentration of the palladium precursor salt in the aqueous solution is between 0.5 mM and 2 mM.

In some implementations of the method, the palladium precursor is dianionic tetrachloropalladate.

In some implementations of the method, the borohydride compound is selected from the group consisting of lithium triethylborohydride, lithium borohydride, and sodium borohydride.

In some implementations of the method, the surface coated with the palladium precursor is reduced with a solution of the borohydride compound having a concentration between 2 mM and 7 mM.

In some implementations of the method, the palladium nanoparticles coated on the surface of the metal oxide conducting electrode have a peak current of 70 μA to 130 μA when a voltage of 510 mV to 600 mV is applied in cyclic voltammetry analysis.

In some implementations, the method further includes treating the palladium nanoparticles coated on the surface of the metal oxide conducting electrode with a strong Arrhenius base.

In some implementations of the method, the strong Arrhenius base is sodium hydroxide or potassium hydroxide.

In some implementations of the method, the palladium nanoparticles coated on the surface of the metal oxide conducting electrode are immersed in a sodium hydroxide or the potassium hydroxide solution having a concentration of 0.05 M-1.5 M.

In some implementations, the method further includes immersing the palladium precursor on the surface of the metal oxide conducting electrode into an organic solution of tetra-n-octylammonium bromide and an aliphatic thiol or aromatic thiol, prior to the reducing.

In some implementations of the method, a thickness of the palladium nanoparticles coated on the surface of the metal oxide conducting electrode is 8 nm to 32 nm.

In some implementations, the method further comprising rinsing the palladium precursor coated on the surface of the metal oxide conducting electrode with water and drying, after the immersing and prior to the reducing.

In some implementations of the method, the metal oxide conducting electrode is immersed for at least 1 hour into the aqueous solution comprising the palladium precursor salt.

In some implementations of the method, the electrocatalytic substrate oxidizes hydroquinone and catechol to benzoquinone at a peak cathodic potential of −0.2 Volts to −0.1 Volts, and a peak anodic potential of −0.05 Volts to 0.15 Volts in a 0.8-0.15 M solution of potassium chloride.

In some implementations of the method, the electrocatalytic substrate oxidizes hydrogen peroxide at a peak anodic potential of 0.3 V to 0.48 V in a 0.8-0.15 M solution of sodium hydroxide.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
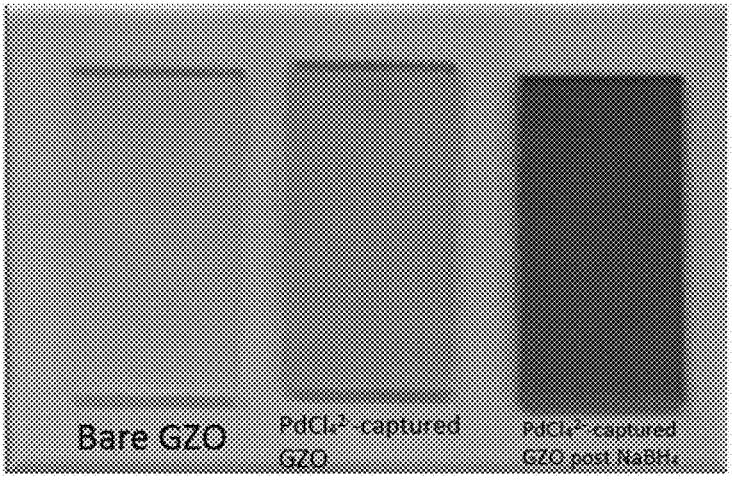
FIG. 1 is a photograph of an electrode before undergoing modification by a palladium precursor, after undergoing modification by a palladium precursor, and after further modification by reduction of the palladium precursor.

Referring now to the drawings, wherein like reference numerals designate identical or corresponding parts throughout the several views.

The present disclosure is directed to a method for manufacturing a palladium coated metal oxide conducting electrode to act as an electrocatalytic substrate. A metal oxide conducting electrode may include, but is not limited to gallium-doped zinc oxide (GZO) or aluminum-doped zinc oxide (AZO). The metal oxide conducting may be used interchangeably with "the electrode" or "the conducting electrode" herein. The process of preparing the palladium coated metal oxide conducting electrode includes immersing the electrode in an aqueous solution of a palladium precursor, preferably a palladate salt, to form the electrode with at least one surface coated with palladium precursor, and reducing the palladium precursor on the electrode with a borohydride compound to form the electrode with at least one surface coated with palladium nanoparticles.

In some implementations, the metal oxide conducting electrode may be AZO or GZO and one element or compound selected from the group consisting of indium tin oxide (ITO), indium zinc oxide (IZO), indium zinc tin oxide (IZTO), indium aluminum zinc oxide (IAZO), indium gallium zinc oxide (IGZO), indium gallium tin oxide (IGTO), antimony tin oxide (ATO), Iridium oxide (IrOx), Ruthenium (RuOx), RuOx/ITO, or IrOx/gold (Au).

In some implementations, the metal oxide conducting electrode may be a multi-layer structure, in which at least one layer is comprised of a polymer, and at least one layer is comprised of metal oxide, and at least one layer is comprised of metal. For example, the multi-layer structure may include poly-3,4-ethylenedioxythiophene, gallium zinc oxide, and palladium metal. In some implementations there may be a mixture of metal oxides in the layer comprised of metal oxides. In some implementations, there may be a mixture of metals in the layer comprised of metal.

The palladium precursor salt may be a tetrachloropalladate (II) salt, such as ammonium tetrachloropalladate (II), preferably potassium tetrachloropalladate (II) or sodium tetrachloropalladate (II), palladium iodide, palladium chloride, palladium bromide, or palladium sulfate. The concentration of the palladium precursor salt in the aqueous solution is at least 0.5 mM, at least 0.75 mM, at least 1 mM, at least 1.25 mM, at least 1.5 mM, at least 1.75 mM, and at most 2 mM. The aqueous solution comprising the palladium precursor salt has a pH of at least 2.5, at least 2.75, at least 3.0, at least 3.25, at least 3.5, at least 3.75, at least 4, at least 4.25, at least 4.5, at least 4.75, and at most 5. The electrode may be immersed in the aqueous solution of the palladium precursor salt for at least 30 minutes, at least 45 minutes, at least 1 hour, at least 1.5 hours, or at most 2 hours. A change in color may indicate that the layer of the palladium precursor has formed on the electrode as shown in FIG. 1. The electrode may be immersed into the solution of the palladium precursor salt perpendicular to the surface of the solution, at a 60 degree angle, at a 45 degree angle, at a 30 degree angle, at a 15 degree angle, at a 10 degree angle, or at a 5 degree angle. A temperature of the aqueous solution of the palladium precursor salt may be between 15° C.-30° C., between 18° C.-28° C., between 20° C.-26° C., or between 22° C.-24° C.

In some implementations, the aqueous solution of the palladium precursor may also include at least one of a platinum precursor, a nickel precursor, a gold precursor, or a silver precursor. The platinum precursor may include, but is not limited to platinum chloride, platinum iodide, or platinum bromide. The nickel precursor may include, but is not limited to nickel chloride, nickel sulfate, nickel acetate, and nickel nitrate. The gold precursor may include, but is not limited to gold chloride and gold bromide. The silver precursor may include, but is not limited to silver acetate, silver nitrate, and silver carbonate.

In some implementations, at least one of the platinum precursor, the nickel precursor, the gold precursor, or the silver precursor may each be in a separate aqueous solution in to which the electrode may be immersed before or after being immersed into the aqueous solution of the palladium precursor.

Immersing as used herein, may include spraying or dipping. Spraying may include dispersion of a solution as a fine mist generated using compressed air, or in which the dispersion itself is pressurized and sprayed onto the electrode as a fine mist. Spraying may also include dispersion through an injector wherein the solution is discharged from a nozzle at the tip of the injector and applied to the electrode by depressing an injector piston. Dipping or dip coating is a controlled immersion and withdrawal of the electrode into a reservoir of a solution for the purpose of depositing a layer of material.

The palladium precursor coating the electrode, formed by immersing the metal oxide conducting electrode in the aqueous solution of the palladium precursor salt, may be a dianionic tetrachloropalladate. The palladium precursor coating the electrode may ionically bond with the substrate. The palladium precursor coating the electrode may be reduced by a solution of borohydride compound selected from the group consisting of lithium triethylborohydride, lithium borohydride, sodium cyanoborohydride, and preferably sodium borohydride. Various other borohydride complexes may also be used that can be derived from such borohydride compounds by addition of additives (e.g. methanol, acetic acid, zinc salts, etc.) to form sodium borohydride-methanol adducts, sodium triacetoxyborohydride, sodium borohydride-zinc complexes, and the like. In some implementations a single, aqueous phase is present during the reducing. Lithium triethylborohydride or lithium borohydride may be prepared in an organic solvent. An organic solvent may include but is not limited to toluene, tetrahydrofuran, or ethyl ether. The solution of the borohydride compound may have a concentration between 0.2 mM and 8 mM, preferably between 2 mM and 7 mM, most preferably between 3 mM and 6 mM. The solution of the borohydride compound may contact the layer of the palladium precursor on the electrode by methods including but not limited to immersing, spraying, or dipping as described herein. The metal oxide conducting electrode may be contacted by the aqueous solution of the borohydride for at least 3 minutes, at least 5 minutes, at least 7 minutes, or at most 10 minutes. The electrode may change color to indicate that the layer of the palladium precursor has been reduced by the borohydride compound to form a layer of palladium(0) nanoparticles on the electrode as shown in FIG. 1. The palladium nanoparticles formed by the present method consist of palladium metal and result in a metallic surface formed on the electrode.

In some implementations, after the immersing, the palladium precursor on the electrode may be rinsed with water and dried. Rinsing includes pouring water over the electrode surface with the layer of palladium precursor and allowing the water to flow off of the electrode surface by holding the electrode vertically and allowing the water to flow by gravity. The rinsing may include but is not limited to immersing, spraying, or dipping, as described herein. The drying may include, but is not limited to air drying at ambient air temperature, air drying under a heated air, drying in a heated vessel, or drying inside a low pressure vessel or container.

In some implementations of the method, prior to reducing the layer of the palladium precursor on the electrode, the method may further include immersing the electrode into an organic solution comprising a phase transfer catalyst and an aliphatic thiol or aromatic thiol, then reducing with the borohydride compound to produce a thiol conjugated palladium nanoparticle. Exemplary phase transfer catalysts include tetra-n-octylammonium bromide, benzyltrimethylammonium chloride, benzyltriethylammonium chloride, methyltricaprylammonium chloride, methyltributylammonium chloride, and methyltrioctylammonium chloride, and the like. The immersing may include spraying, dipping, or rinsing as described herein. In one embodiment, the phase transfer catalyst is tetra-n-octylammonium bromide. Tetra-n-octylammonium bromide may be prepared in an organic solvent such as, but not limited to toluene, heptane, or hexanes. The tetra-n-octylammonium bromide may be prepared in the organic solvent at a concentration between 2 mM and 10 mM, between 3 mM and 8 mM, or between 4 mM and 6 mM. The aliphatic thiol or the aromatic thiol may be prepared in the organic solvents as discussed herein with the tetra-n-octylammonium bromide and may be prepared at concentration between 2 mM and 10 mM, between 3 mM and 8 mM, or between 4 mM and 6 mM. The thiol conjugated palladium nanoparticle may be beneficial for long term storage of the electrode to retain the layer of the palladium nanoparticles on the electrode and retain a plurality of electrocatalytic properties as discussed herein. The aliphatic thiol may include, but is not limited to polyethylene glycol-methyl-ether-thiol, ethanethiol, butanethiol, or mercaptohexanol. The aromatic thiol may include, but is not limited to thiophenol, toluenedithiol, or napthalenethiol.

Figure 2:
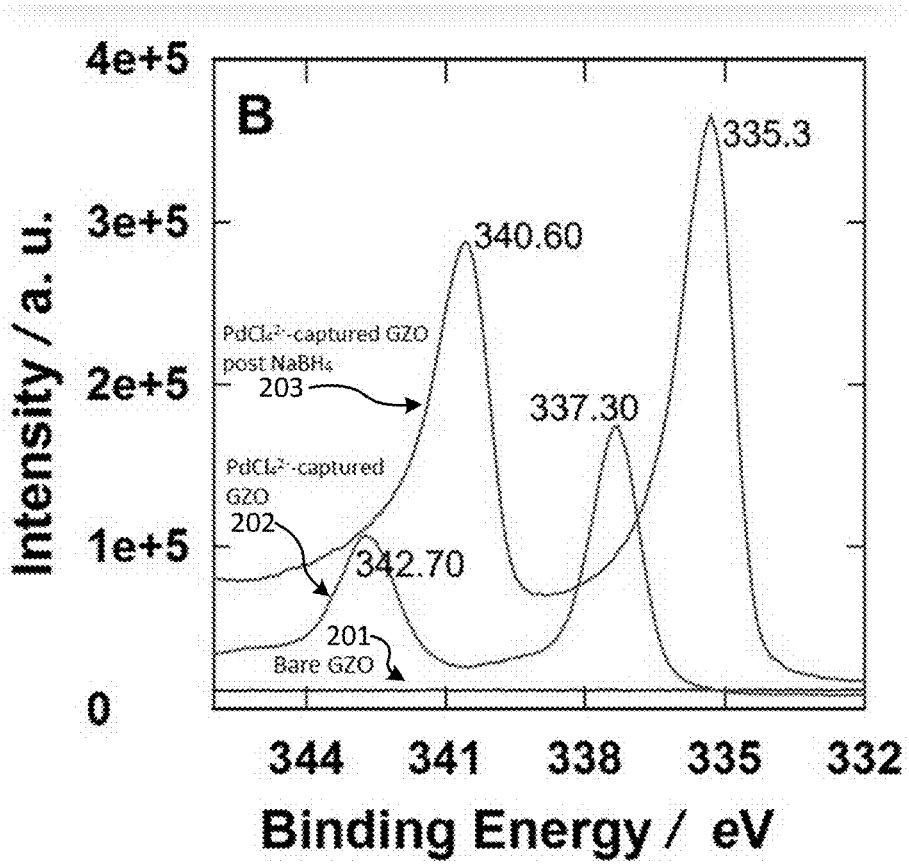
FIG. 2 is an XPS spectrum of an electrode before undergoing modification by a palladium precursor, after undergoing modification by a palladium precursor, and after further modification by reduction of the palladium precursor.

After reducing the layer of the palladium precursor, the layer of the palladium nanoparticles remains on the metal oxide conducting electrode. For example, FIG. 2 depicts an X-ray photoelectron spectroscopic (XPS) measurement of the bare metal oxide conducting electrode 201 (bare GZO, FIG. 2), an XPS measurement of the palladium precursor layer on the bare metal oxide conducting electrode 202 ($PdCl_4^{2-}$ captured GZO), and an XPS measurement of the palladium precursor layer after reduction by a borohydride compound 203 ($PdCl_4^{2-}$ captured GZO post $NaBH_4$.) The electrode with the layer of palladium nanoparticles acts as the electrocatalytic substrate, as used herein.

The palladium nanoparticles remaining on the electrode after the reducing of the palladium precursor may have a diameter between 8 nm and 22 nm, 10 nm and 20 nm, 12 nm and 18 nm, or 14 nm and 16 nm. The layer of palladium nanoparticles on the electrode may have a density between $0.5\times10^{-3}$ Pd·nm$^{-2}$ and $4.5\times10^{-3}$ Pd·nm$^{-2}$, between $1.0\times10^{-3}$ Pd·nm$^{-2}$ and $4.0\times10^{-3}$ Pd·nm$^{-2}$, between $1.5\times10^{-3}$ Pd·nm$^{2}$ and $3.5\times10^{-3}$ Pd·nm$^{-2}$, or between $2.0\times10^{-3}$ Pd·nm$^{-2}$ and $3.0\times10^{-3}$ Pd·nm$^{2}$. In some implementations, a thickness of the layer of the palladium nanoparticles may be between 8 nm to 32 nm, between 10 nm and 28 nm, between 12 nm and 24 nm, or between 14 nm and 20 nm.

In some implementations, the thickness of the layer of palladium nanoparticles may vary from location to location on the electrode by 1% to 15%, by 3%-10%, and by 5%-8%.

In some implementations, the thickness of the layer of palladium nanoparticles on the electrode may be varied by immersing a portion of the electrode, which is smaller than the electrode, into the precursor solution two times, three times or four times, followed by reducing to form distinct palladium nanoparticle layers on the electrode of varying thickness. In some implementations, a support compound, such as a reduced graphene oxide, may be used to vary the thickness of the layer of palladium nanoparticles.

In some implementations the electrocatalytic substrate may be characterized by an electrocatalytic measurement by a cyclic voltammetry analysis. In some implementations, prior to the cyclic voltammetry analysis, the electrocatalytic substrate may be treated with an aqueous solution of a strong Arrhenius base to strip away any hydrogen atoms that have complexed to the palladium and reduce the electrocatalytic efficiency of the electrode with the layer of nanoparticles. The strong Arrhenius base may be, but is not limited to, sodium hydroxide or potassium hydroxide. The concentration of an aqueous solution of sodium hydroxide or potassium hydroxide may be at least 0.05 M, at least 0.75 M, at least 1 M, at least 1.25 M, or at least 1.5 M. The palladium nanoparticles may be treated by the strong Arrhenius base by immersing, spraying, or rinsing.

The layer of the palladium nanoparticles on the electrode may generate a peak current between 70 μA to 130 μA, between 80 μA and 120 μA, between 90 μA and 110 μA, upon applying a voltage between 510 mV to 600 mV, between 520 mV to 590 mV, between 530 mV and 580 mV, and between 540 mV and 570 mV.

In some implementations of the method, the electrocatalytic substrate may oxidize hydroquinone and catechol to benzoquinone in a solution of a chloride salt. The chloride salt may include, but is not limited to sodium chloride or potassium chloride. The chloride salt may be at a concentration of at least 0.8 M, at least 0.1 M, at least 0.12 M, or at least 0.15 M. The electrocatalytic substrate a peak cathodic potential between −0.2 Volts to −0.1 Volts, between −0.18 Volts to −0.12 Volts, or between −0.16 Volts to −0.14 Volts. The electrocatalytic substrate may oxidize hydroquinone to 1,2-benzoquinone and oxidize catechol to 1,4 benzoquinone at a peak anodic potential between −0.05 Volts to 0.15 Volts, between −0.03 Volts to 0.1 Volts, between 0.00 Volts to 0.05 Volts.

In some implementations of the method, the electrocatalytic substrate may oxidize hydrogen peroxide in a solution of an hydroxide. The hydroxide may include, but is not limited to sodium hydroxide or potassium hydroxide. The hydroxide may be at a concentration of at least 0.8 M, at least 0.1 M, at least 0.12 M, or at least 0.15 M. The electrocatalytic substrate a peak anodic potential between 0.25 Volts to 0.5 Volts, between 0.3 Volts to 0.45 Volts, or between 0.35 Volts to 0.4 Volts.

In some implementations of the method, the electrocatalytic substrate may oxidize ferrocyanide in a solution of chloride salt. The chloride salt may include, but is not limited to sodium chloride or potassium chloride. The chloride salt may be at a concentration of at least 0.8 M, at least 0.1 M, at least 0.12 M, or at least 0.15 M. The electrocatalytic substrate a peak anodic potential between 0.25 Volts to 0.5 Volts, between 0.3 Volts to 0.45 Volts, or between 0.35 Volts to 0.4 Volts.

The examples below are intended to further illustrate the method to prepare palladium nanoparticle on GZO electrodes, and are not intended to limit the scope of the claims.

Example 1

In the conditions tested to prepare Palladium nanoparticles (PdNPs) on GZO electrodes, $PdCl_4^{2-}$ could be captured on the GZO surface simply by immersing the GZO electrode in a solution of $K_2PdCl_4$. Capture of $PdCl_4^{2-}$ molecules appeared to be significant since a blackish-violet-colored GZO electrode was produced in a follow-up reduction reaction in the presence of $NaBH_4$, as depicted in FIG. 1. The blackish-violet-color was observed for aluminum-doped zinc oxide (AZO) electrode however the same change of color never proceeded on an indium tin oxide (ITO) electrode which indicated that $PdCl_4^{2-}$ capture was not successful on the ITO electrode.

Materials and Methods

Reagents

Potassium tetrachloropalladate(II) ($K_2PdCl_4$), sodium hydroxide, potassium chloride (KCl), hydrogen peroxide (30% w/v) ($H_2O_2$), catechol (CT), hydroquinone (HQ), and potassium ferrocyanide ($K_4[Fe(CN)_6]$) were obtained from Sigma-Aldrich (USA). Ethanol was supplied by Carlo Erba Reagents (France). Sodium borohydride ($NaBH_4$) was obtained from BDH Laboratory Suppliers (Poole, England). Gallium-doped zinc oxide-coated glass (GZO) (25 Ω/sq), aluminum-doped zinc oxide-coated glass (AZO) (45 Ω/sq) and indium tin oxide-coated glass (ITO) (5 Ω/sq) were purchased from Geomatec, Japan. All solutions were prepared using deionized water obtained from a water purification system (Barnsteadm Nanopure™, Themoscientific, 7148, USA).

Preparation of PdNP-Modified GZO

GZO electrodes were successively cleaned through 5 min sonication periods in ethanol and water, followed by drying under an air stream using an air dryer. The cleaned electrodes were immersed in aqueous solutions containing 1 mM $K_2PdCl_4$ for 1 hour to capture a palladium precursor. Within a few minutes, the colorless GZO electrodes changed to yellow owing to the $PdCl_4^{2-}$ capture process, as depicted in FIG. 1. Next, the electrode was washed with water and subsequently dried under an air stream. The captured $PdCl_4^{2-}$ ions on the GZO electrode were then immersed in a freshly prepared 5 mM $NaBH_4$ (aq.) solution for 5 minutes. Finally, the palladium modified GZO electrode (PdNP-GZO) was washed with water and dried under an air stream.

Instrumentation

Field emission scanning electron microscopy (FE-SEM) images were obtained using a field emission SEM (TESCAN LYRA 3, Czech Republic). Energy dispersive X-ray spectroscopy (EDS) spectra and area mappings were recorded using an Oxford instrument EDS detector equipped with the Lyra3 TESCAN FESEM. An XPS equipped with an Al-Kα micro-focusing X-ray monochromator (ESCALAB 250Xi XPS Microprobe, Thermo Scientific, USA) was employed to obtain the surface chemical analysis of the bare GZO and Pd-GZO electrodes. A CHI 700E instrument (CH Instruments, Austin, Tex., USA) was used for all electrochemical experiments. The electrochemical cell consisted of a bare GZO or PdNP-GZO or Pd disk working electrode, a Platinum (Pt) counter electrode, and an Ag/AgCl (3 M KCl) reference electrode. Each solution was deaerated with nitrogen bubbling before each electrochemical measurement. The geometric area of the Pd disk electrode was four times smaller than the exposed area of the bare or modified GZO (i.e. with PdNP) in the electrochemical experiments. The obtained current at the Pd disk electrode was multiplied by four to obtain the current corresponding to the same surface area, for appropriate. The pH of the $K_2PdCl_4$ solution was recorded using a Dual Channel pH meter, XL60, Fisher Scientific.

Example 2

Results and Discussion

Preparation, Chemical Composition, and Morphological Characteristics of PdNP-GZO Initially, the bare GZO electrode was immersed in an aqueous solution containing 1 mM $K_2PdCl_4$ to capture the dianionic tetrachloropalladate ($PdCl_4^{2-}$) ions. After washing and drying, the color of the GZO electrode was yellow (FIG. 1), which approximated the color of an aqueous solution of $K_2PdCl_4$ and differed significantly from the glass-like color of the original GZO electrode (FIG. 1). The significant color change indicated the capture of sufficient amounts of $PdCl_4^{2-}$ on the GZO electrode surface 202, as further confirmed by XPS analysis (FIG. 2). The background XPS spectrum in FIG. 2 corresponds to the bare GZO electrode 201. The two peaks at 342.70 and 337.30 eV in the $PdCl_4^{2-}$/GZO electrode spectra 202 (FIG. 2) were attributed to Pd $3d_{3/2}$ and Pd $3d_{5/2}$, respectively, indicating the presences $Pd^{2+}$ ions. The attachment of $PdCl_4^{2-}$ ions to the GZO electrode surface might be via electrostatic attraction, as the pH of the 1 mM $K_2PdCl_4$ (aq) solution was 3.5, and the isoelectric point (IEP) of the GZO could be inferred as falling between 9 and 10, because the IEPs of the $Ga_2O_3$ and ZnO were 9 or 9-10, respectively. Also the attachment of $PdCl_4^{2-}$ ions to the GZO electrode surface might be the cause of complex formation between Pd precursor and GZO surface.

The yellowish color of the $PdCl_4^{2-}$ ions attached to the GZO electrode surface changed to a blackish-violet (FIG. 1) upon treatment with an aqueous solution of $NaBH_4$. No color changes were observed upon treatment of the bare GZO electrode with an aqueous solution of $NaBH_4$. The blackish-violet color formation arose from the formation of PdNPs via the reduction of pre-captured $PdCl_4^{2-}$ 203 to metallic Pd, as supported by the XPS analysis, in which peaks were observed at 340.60 and 335.30 eV in the spectrum (FIG. 2), corresponding to Pd $3d_{3/2}$ and Pd $3d_{5/2}$, respectively.

Separate experiments showed that $PdCl_4^{2-}$ ions could be attached onto AZO or ITO electrodes by exposing the AZO or ITO electrodes to aqueous solutions of 1 mM $K_2PdCl_4$. The experimental results confirmed the attachment of the $PdCl_4^{2-}$ ions onto AZO as the color of AZO changed from transparent to yellow, as observed in the $PdCl_4^{2-}$/GZO electrode. The ITO electrode color remained unchanged, indicating the absence of $PdCl_4^{2-}$ attachment. Further treatment with $NaBH_4$ (aq.) did not produce a color change in the $K_2PdCl_4$-treated ITO electrode. The color of the $K_2PdCl_4^{2-}$ treated AZO electrode transitioned to blackish-violet upon treatment with $NaBH_4$ (aq.) due to the formation of PdNPs. These experiments confirm that the method presented herein for the preparation of PdNPs is typical of GZO electrode and AZO electrode.

Figure 3A:
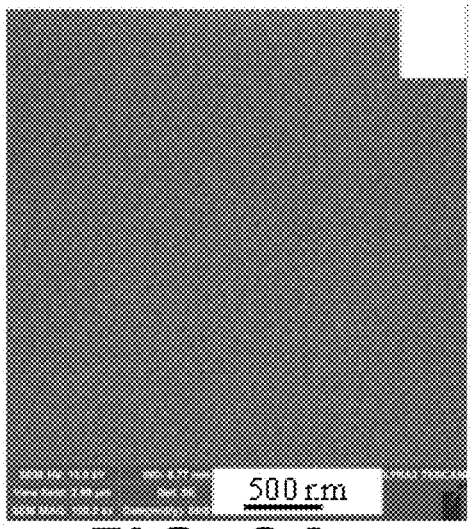
FIG. 3A is a FE-SEM secondary electron image of an electrode before undergoing modification by a palladium precursor at 10 kV and 100,000× magnification.
Figure 3B:
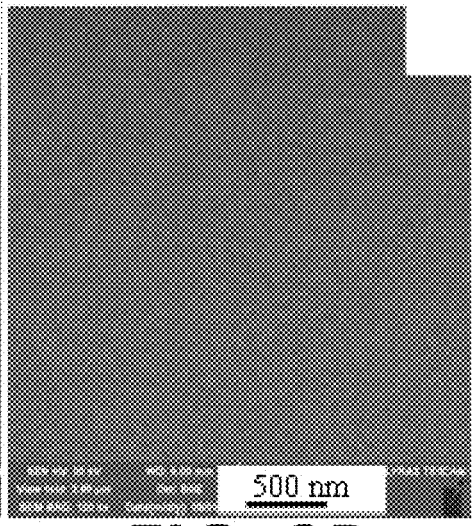
FIG. 3B is a FE-SEM backscattered electron image of an electrode before undergoing modification by a palladium precursor at 30 kV and 100,000× magnification.
Figure 3C:
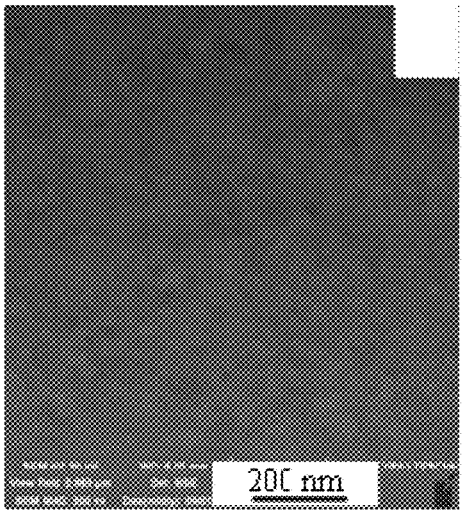
FIG. 3C is a FE-SEM backscattered electron image of an electrode before undergoing modification by a palladium precursor at 30 kV and 300,000× magnification.
Figure 3D:
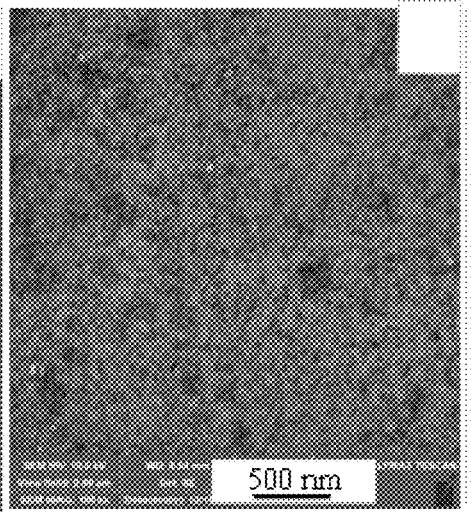
FIG. 3D is a FE-SEM secondary electron image of an electrode after undergoing modification by a palladium precursor at 10 kV and 100,000× magnification.
Figure 3E:
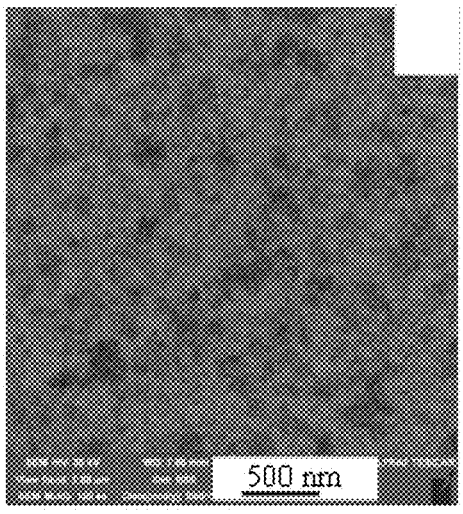
FIG. 3E is a FE-SEM backscattered electron image of an electrode after undergoing modification by a palladium precursor at 30 kV and 100,000× magnification.
Figure 3F:
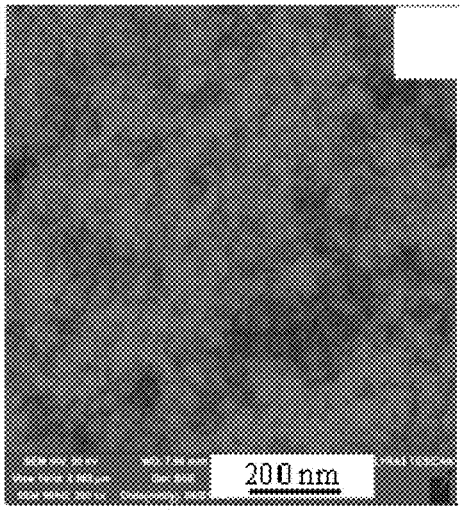
FIG. 3F is a FE-SEM backscattered electron image of an electrode after undergoing modification by a palladium precursor at 30 kV and 300,000× magnification.

The formation of PdNPs upon treating the $PdCl_4^{2-}$/GZO electrode composite with $NaBH_4$ was investigated by collecting FE-SEM images of the electrode surfaces (FIGS. 3A, 3B, and 3C). Secondary electron images (FIG. 3D) and backscattered electron images (FIGS. 3E and 3F) of PdNP-GZO electrode revealed that the PdNPs (greyish-white) were interconnected and uniformly dispersed across the GZO electrode surface after treatment of the $PdCl_4^{2-}$/GZO electrode with $NaBH_4$. The NP size distribution fell in the range of 10-20 nm (FIG. 3F). No such NPs were observed on the bare GZO electrode surfaces (FIGS. 3A, 3B, and 3C).

Figure 4A:
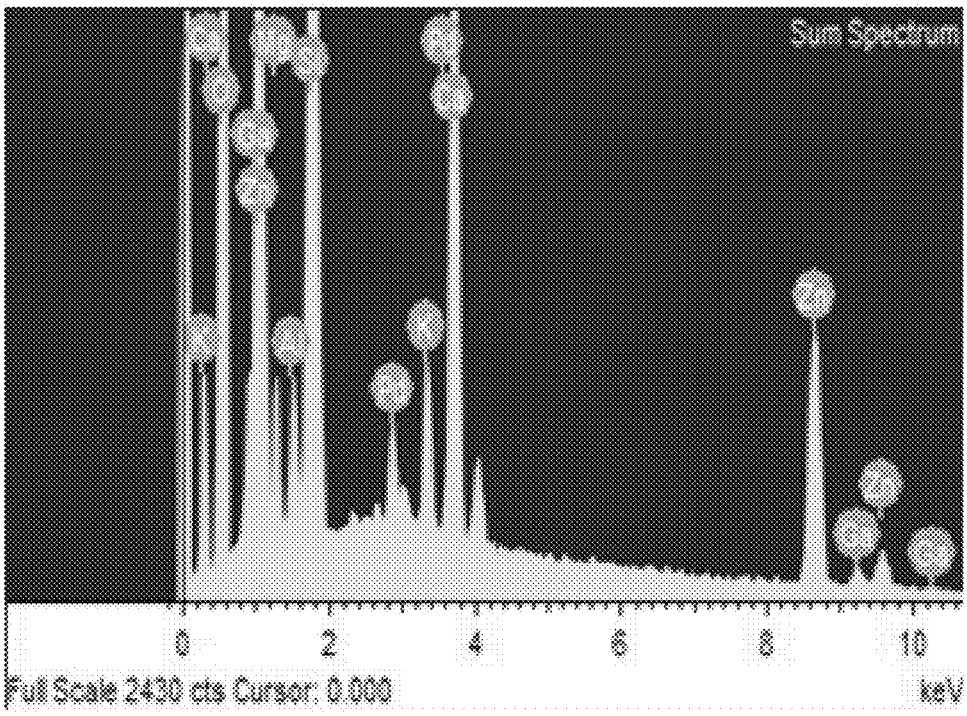
FIG. 4A is an EDS spectrum of palladium nanoparticle on a GZO electrode.

An elemental composition of the PdNPs-GZO electrode was obtained by collecting an EDS spectrum, as shown in FIG. 4A. The EDS spectrum confirmed that the major peaks corresponded to Ga, Zn, O, Pd, Si, Al, Ca, and K elements. The EDS spectrum revealed that the modified electrode surfaces were composed of Ga, Zn, O, Pd, and K, whereas the Si, Al, Ca peaks observed in the EDS spectrum were attributed to the glass. The presence of K on the PdNP-GZO electrode may have resulted from physical adsorption/absorption during treatment with $K_2PdCl_4$.

Figure 4B:
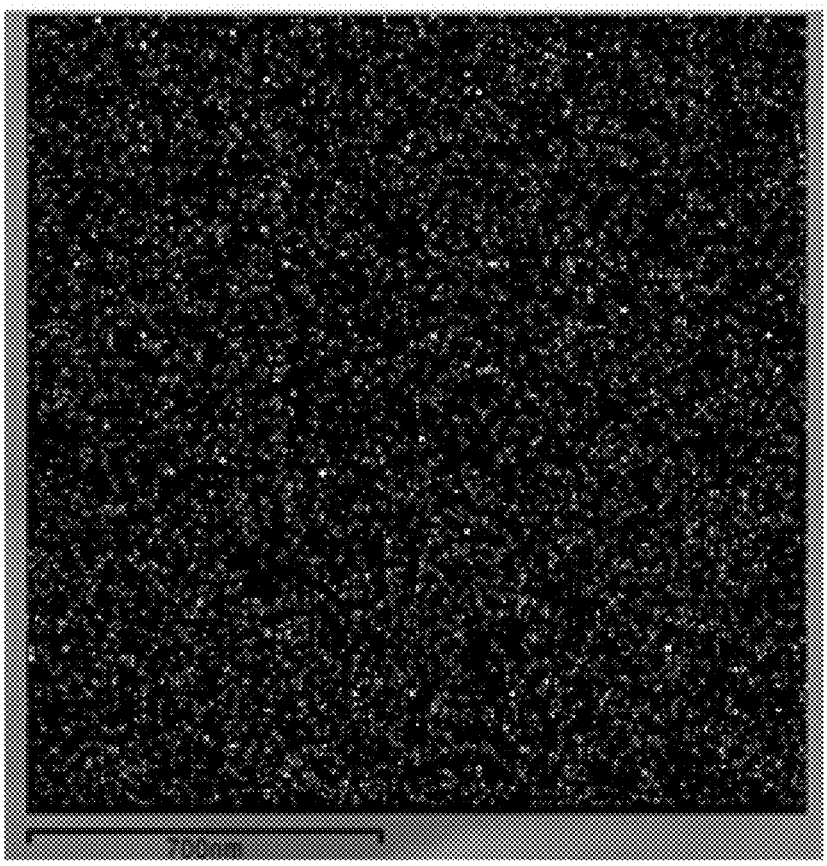
FIG. 4B is an EDS mapping of palladium nanoparticles on a GZO electrode.

FIG. 4B shows the EDS area mapping of the PdNP-GZO electrode. Here, the dots observed in the mapping correspond to the PdNPs. The EDS area mapping revealed that the PdNPs were evenly dispersed across the GZO electrode surface.

Electrochemical Characterization of the PdNP-GZO Electrode in an Alkaline Solution (0.1 M NaOH)

Figure 5A:
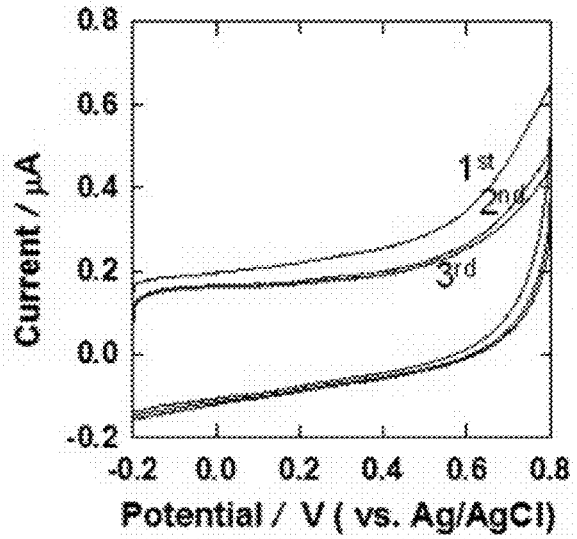
FIG. 5A is a successive cycle cyclic voltammogram at scan rate of 50 mV/s of a bare GZO electrode.
Figure 5B:
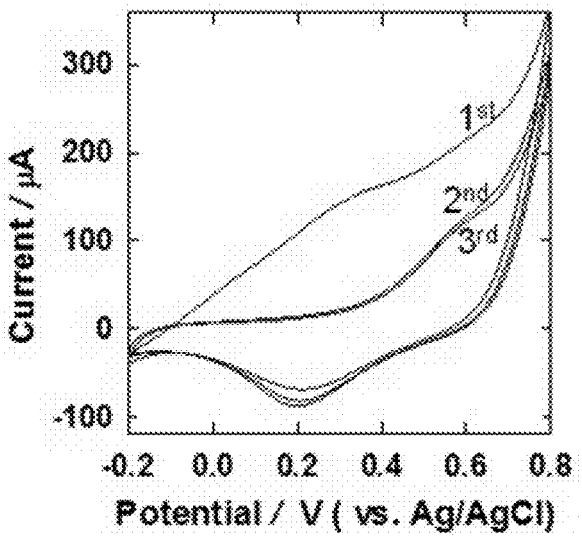
FIG. 5B is a successive cycle cyclic voltammogram at a scan rate of 50 mV/s of a GZO electrode with palladium nanoparticles.
Figure 5C:
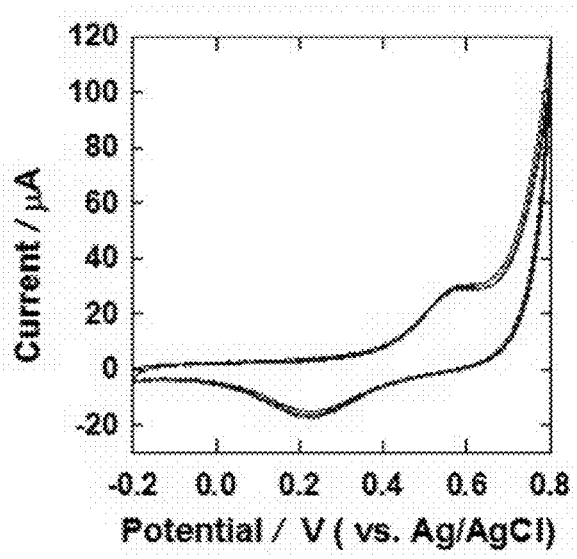
FIG. 5C is a successive cycle cyclic voltammogram at scan rate of 50 mV/s of a palladium disk electrode.

FIGS. 5A and 5B depict three successive cyclic voltammogram (CV) measurements obtained using GZO or PdNP-GZO electrodes in 0.1 M NaOH (aq.) solution, respectively. The CVs obtained using GZO electrode revealed that the background current decreased slightly from the first to the $2^{nd}$ cycles and remained constant from the $2^{nd}$ to the $3^{rd}$ cycles. The GZO electrode revealed a nearly flat background current until 0.5 V (FIG. 5A). After 500 mV, the background increased slightly, possibly due to the electroactive moieties present on the electrode surface, as observed previously using other working electrodes. The PdNP-GZO electrode revealed significantly higher anodic and cathodic currents compared to the currents obtained from the bare GZO electrode (FIG. 5B). At the first cycle, the anodic current began at the starting potential of the CVs, and a broad anodic peak ($E_{pa}$) was observed at +360 mV. A significantly lower anodic current was observed in the subsequent cycle, and this current remained constant during the third cycles (FIG. 5B). During the $2^{nd}$ cycle, the anodic current started at +400 mV, and $E_{pa}$ appeared at ca. +600 mV. Interestingly, the cathodic peak current ($i_{pc}$) and the peak position ($E_{pc}$, ca. 200 mV) remained unchanged from the $1^{st}$ to the $3^{rd}$ cycles (FIG. 5B). The anodic current with $E_{pa}$ of +600 mV during the $2^{nd}$ cycle corresponded to the formation of hydroxide or oxide on the PdNP surface. The oxidized PdNPs were reduced during the reverse scan. These Pd oxidation and reduction mechanisms were confirmed by recording the CV of the bulk Pd electrode in 0.1 M NaOH (FIG. 5C). The shape of the CV at the bulk Pd electrode resembled that of the PdNP-GZO electrode in the $2^{nd}$ and $3^{rd}$ cycles and remained unchanged between the $1^{st}$ and $3^{rd}$ cycles. The $E_{pa}$ and $E_{pc}$ of the bulk Pd electrode were found to be +580 and +215 mV, respectively. The $E_{pc}$ of the PdNP-GZO electrode was similar to that obtained from the Pd bulk electrode. These experiments further confirmed the presence of Pd on PdNP-GZO electrode. On the other hand, the anodic peak current ($i_{pa}$) and the $i_{pc}$ of PdNP-GZO electrode during the $2^{nd}$ and 3rd cycles (FIG. 5B) were much higher than the corresponding values measured from the Pd disk electrode (FIG. 5C), indicating that PdNP-GZO electrode possessed a higher electroactive surface area than the bulk Pd electrode.

The CV shown in FIG. 5B was closely reproduced upon application of the experimental conditions to different PdNP-GZO electrodes. A PdNP-GZO electrode sample aged for three months yielded a CV similar to that shown in FIG. 5B, which indicated a high stability and reproducibility in PdNP-GZO.

Figure 5D:
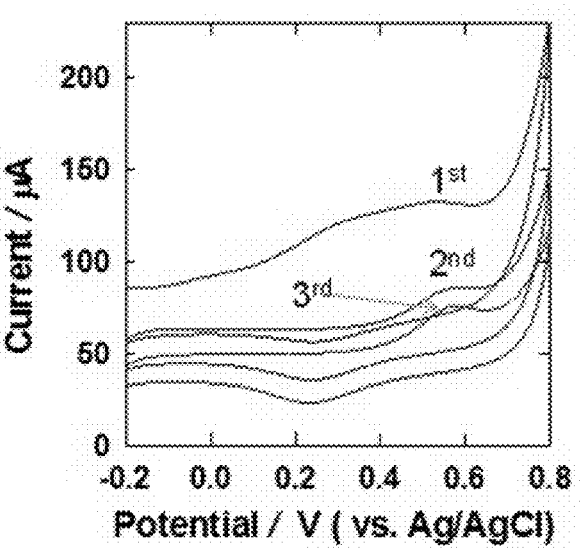
FIG. 5D is a successive cycle cyclic voltammogram at scan rate of 50 mV/s of a palladium disk electrode after treatment with $NaBH_4$.

The origin of the high anodic current observed during the first cycle at PdNP-GZO electrode (FIG. 5B) was investigated by recording the CV in 0.1 M NaOH using a bulk Pd electrode after treating with an aqueous solution containing 5 mM $NaBH_4$ and subsequently washing with water (FIG. 5D). Hydrogen has been shown to adsorb onto Pd surfaces upon treatment of a Pd electrode with a $NaBH_4$ solution. The treated disk electrode provided a higher anodic current with an $E_{pa}$ at ca. 530 mV compared to the current obtained from the untreated bulk Pd electrode. The high anodic current measured at the $NaBH_4$-treated bulk Pd electrode most likely corresponded to the oxidation of adsorbed hydrogen. The anodic current decreased significantly in subsequent cycles, and the shape of the CV measured during the $3^{rd}$ cycle was similar to that measured at the un-treated Pd bulk electrode. These experiments indicated that the high anodic current at the PdNP-GZO reflected the oxidation of hydrogen adsorbed onto PdNP during the reduction of $PdCl_4^{2-}$ by $NaBH_4$ to form PdNP. As the PdNP-GZO electrode provided a very high background current during the first CV cycle due to hydrogen oxidation, the PdNP-GZO electrode was treated electrochemically by recording three successive cycles in 0.1 M NaOH to eliminate hydrogen fouling prior to evaluating the electrochemical properties in further electrochemical experiments. To enable an appropriate comparison, the bare GZO electrode and Pd disk electrode were also treated in 0.1 M NaOH prior to evaluating the electrochemical properties in further electrochemical experiments.

Figure 6A:
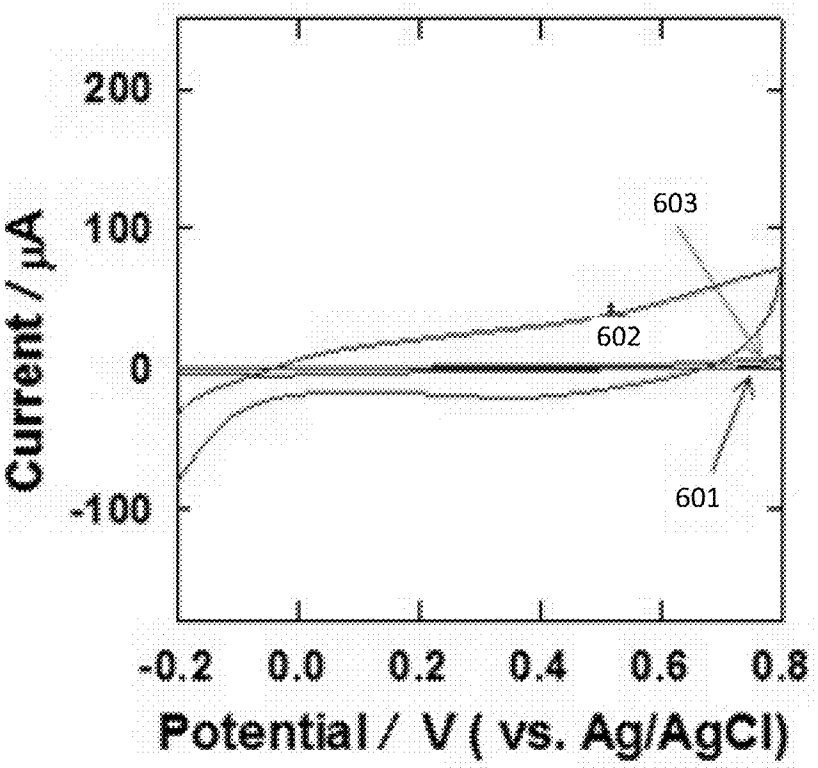
FIG. 6A is a cyclic voltammogram in the absence of $K_4[Fe(CN)_6]$ at a scan rate of 50 mV/s.

Electrochemical Properties of PdNP-GZO Electrode Toward $[Fe(CN)_6]^{4/3-}$ Redox Couples The electrochemical behaviors of GZO electrode 601, PdNP-GZO electrode 602, and the Pd disk electrode 603 were evaluated by recording the CV in 0.1 M KCl in the absence (FIG. 6A) or presence (FIG. 6B) of 5 mM $K_4[Fe(CN)_6]$. The PdNP-GZO electrode and Pd disk electrode displayed a background current that was higher than that of the bare GZO electrode. The high background current may have resulted from the oxidation of Pd, which was later reduced in successive cathodic scans (FIG. 6A); however, the background current measured at PdNP-GZO electrode 602 was higher than that obtained at the Pd disk electrode 603 due to the greater electroactive surface area at PdNP-GZO electrode than that at the Pd disk electrode, in agreement with the CV experiments conducted in 0.1 M NaOH.

Figure 6B:
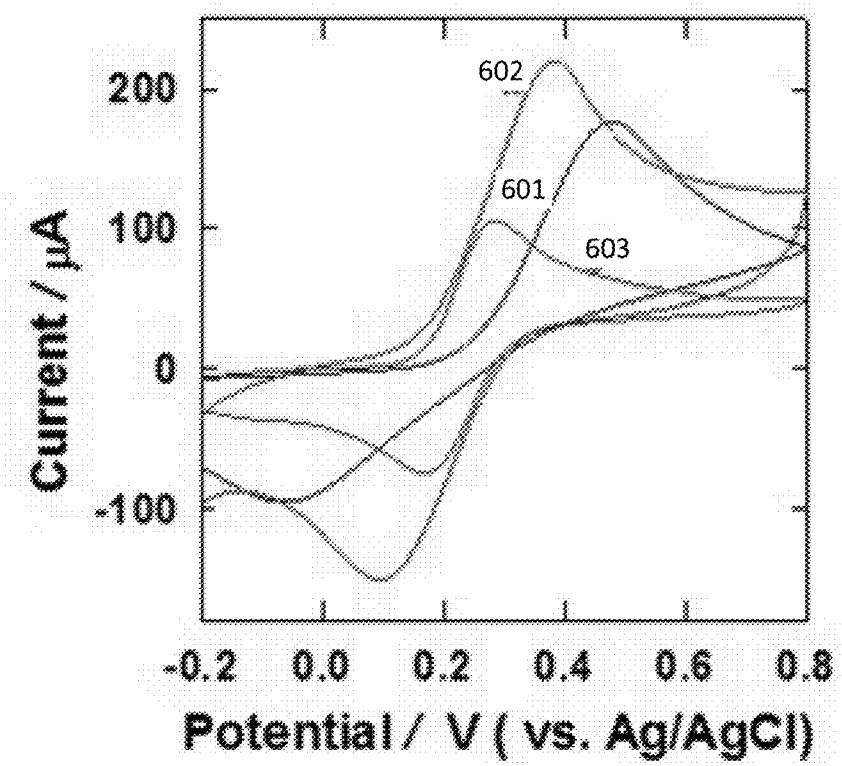
FIG. 6B is a cyclic voltammogram in the absence of $K_4[Fe(CN)_6]$ at a scan rate of 50 mV/s.

The oxidation of $[Fe(CN)_6]^{4-}$ at the GZO electrode started from 0.2 V, and the corresponding $E_{pa}$ and $E_{ca}$ were found to be +475 and −60 mV (i.e. $\Delta E_p$=535 mV), respectively. The oxidation of $[Fe(CN)_6]^{4-}$ on PdNP-GZO electrode 602 occurred initially at 0.1 V, and the corresponding $E_{pa}$ and $E_{ca}$ values were found to be +380 and +90 mV (i.e. $\Delta E_p$=290 mV), respectively. Interestingly, the CV of PdNP-GZO electrode 602 shown in FIG. 6B remained nearly unchanged after 10 consecutive cycles, indicating a high stability of the PdNP-GZO electrode 602 electrode. The redox currents in the $[Fe(CN)_6]^{4-/3-}$ currents at PdNP-GZO electrode 602 were also significantly higher than the current measured at the GZO electrode 601 electrode (FIG. 6B). In total, the experiments indicated that the PdNP-GZO electrode 602 yielded a much higher electrocatalytic activity toward the redox reaction of the $[Fe(CN)_6]^{4-/3-}$ couple compared to the bare GZO electrode 601. On the other hand, the $E_{pa}$ and $E_{ca}$ values obtained from the $[Fe(CN)_6]^{4-/3-}$ redox couple at the Pd disk 603 electrode were 285 and 170 mV, i.e., $\Delta E_p$=115 mV, lower than the value obtained at PdNP-GZO electrode 602. The redox current of the Pd disk 603 electrode obtained from the $[Fe(CN)_6]^{4-/3-}$ redox couple was the lowest value among the tested electrodes. These experiments indicated that the electrochemical properties of PdNP-GZO electrode 602 were comparable to those of the Pd disk 603 electrode and bare GZO electrode 601.

Figure 7B:
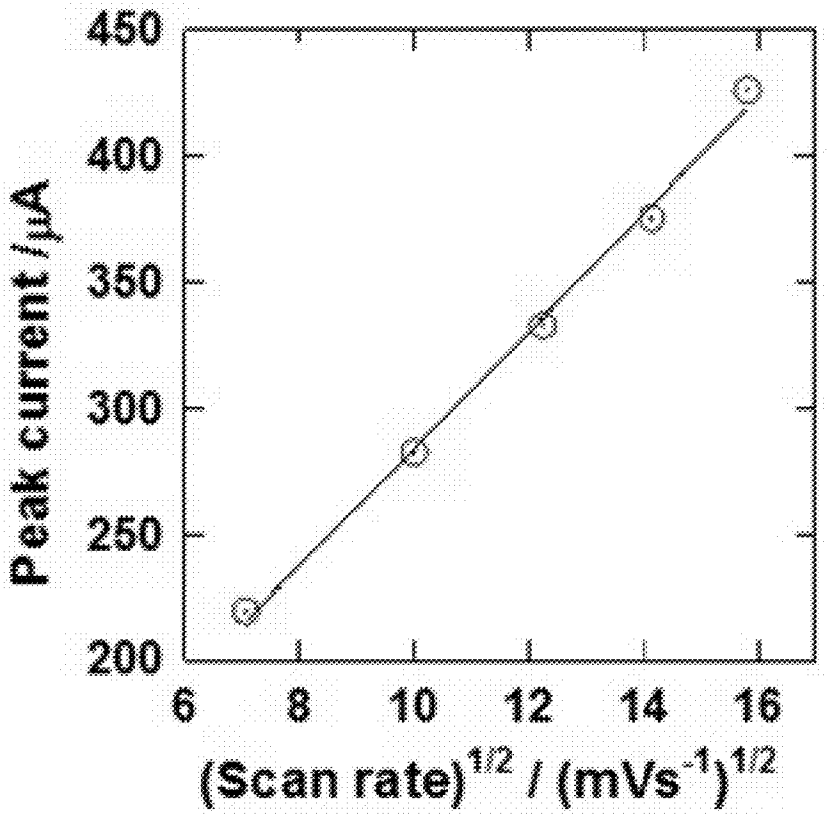
FIG. 7B is a plot of the square root of the scan rate vs. the anodic peak current.
Figure 7A:
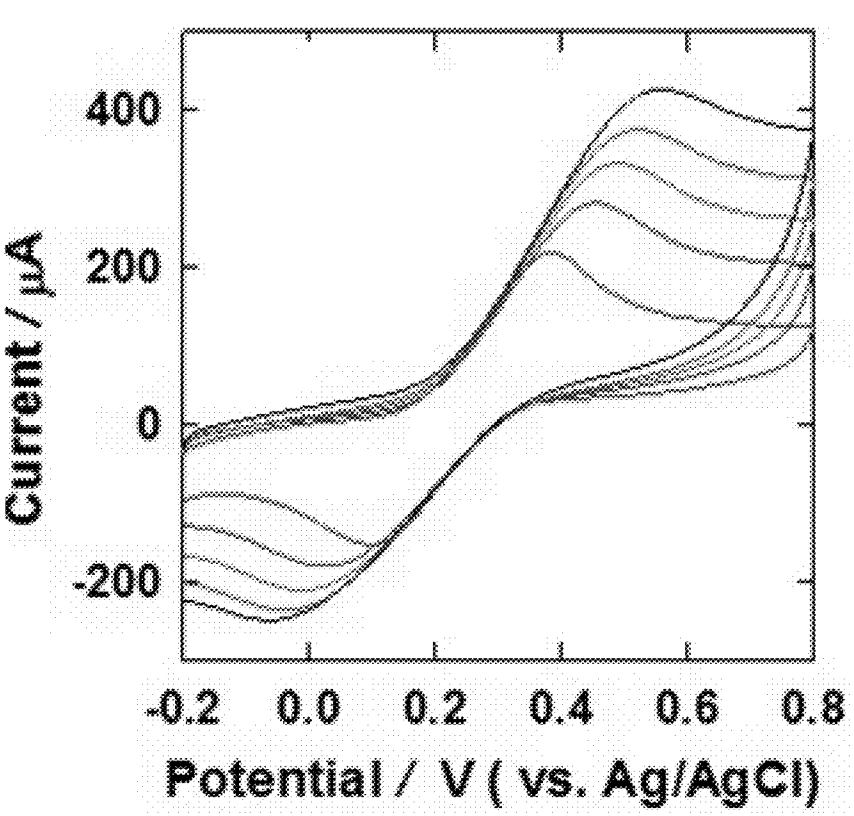
FIG. 7A is a cyclic voltammogram at various scan rates in 0.1 M KCl in the presence of 5 mM $K_4[Fe(CN)_6]$ at the GZO electrode at various scan rates between 50 mV/s to 250 mV/s (e)

FIG. 7A presents cyclic voltammograms obtained from PdNP-GZO electrode at various scan rates. The peak current and $\Delta E_p$ value increased with the scan rate, from 50 $mVs^{-1}$ to 250 $mVs^{-1}$. FIG. 7B shows the corresponding plot of the anodic peak current as a function of the square root of the scan rate (Randles-Sevcik plot). The plot was linear over the full range of scan rates tested ($R^2$=0.996), indicating that the reaction process was diffusion-controlled.

Figure 8A:
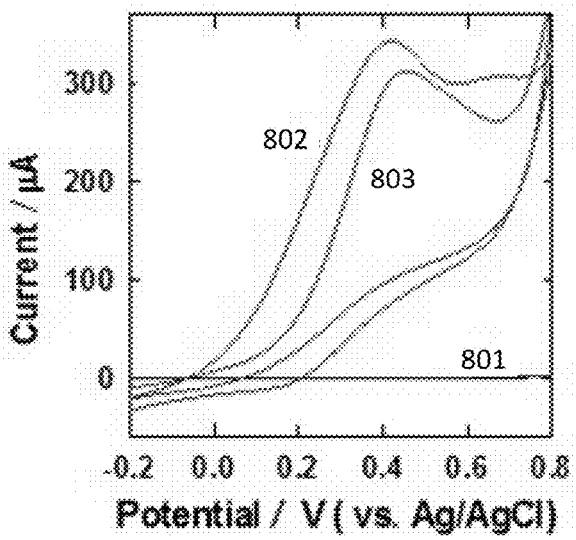
FIG. 8A is a cyclic voltammogram in 0.1 M NaOH in the presence of 5 mM $H_2O_2$ of the bare GZO electrode, for a GZO electrode with palladium nanoparticles, and for a palladium disk electrode.

Electrocatalytic Properties of PdNP-GZO Electrode Toward the Electrochemical Reaction of Hydrogen Peroxide ($H_2O_2$), Hydroquinone, and Catechol The observation of good electrochemical responses for $[Fe(CN)_6]^{4-}$ with PdNP-GZO electrode led us to measure the electrochemical responses of three other electroactive molecules. FIG. 8A presents the CVs obtained in 5 mM $H_2O_2$ and 0.1 M NaOH at the bare GZO electrode 801, PdNP-GZO electrode 802, or Pd disk electrode 803. In this case, the bare GZO electrode 801 was unable to oxidize or reduce $H_2O_2$ over the entire range of potentials tested (−0.2 to +0.8 V), whereas PdNP-GZO electrode 802 showed a significantly high electrooxidation current with an $E_{pa}$ of 422 mV. This $E_{pa}$ was low enough to fabricate a sensitive and selective $H_2O_2$ sensor. The $E_{pa}$ measured from $H_2O_2$ oxidation on a Pd disk 803 electrode was obtained at 455 mV, much higher than the value obtained at PdNP-GZO electrode. The $i_{pa}$ and the starting potential for $H_2O_2$ electrooxidation at the Pd disk 803 electrode were lower and higher, respectively, than the values obtained at PdNP-GZO electrode 802.

Figure 8B:
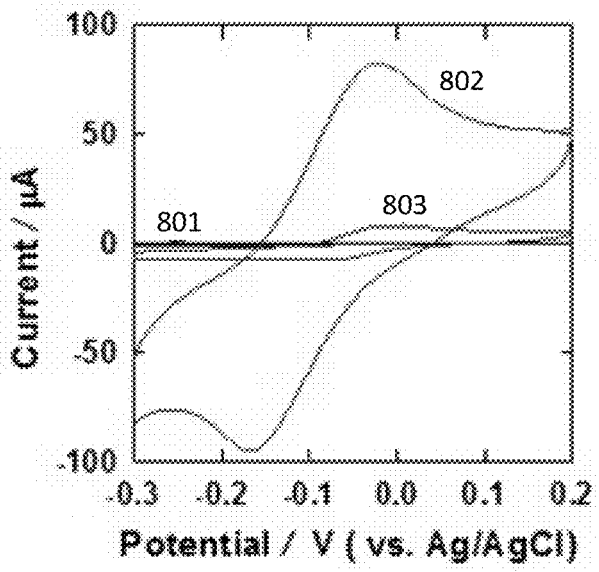
FIG. 8B is a cyclic voltammogram in 0.1 M KCl in the presence of 1 mM HQ of the bare GZO electrode, for a GZO electrode with palladium nanoparticles, and for a palladium disk electrode.
Figure 8C:
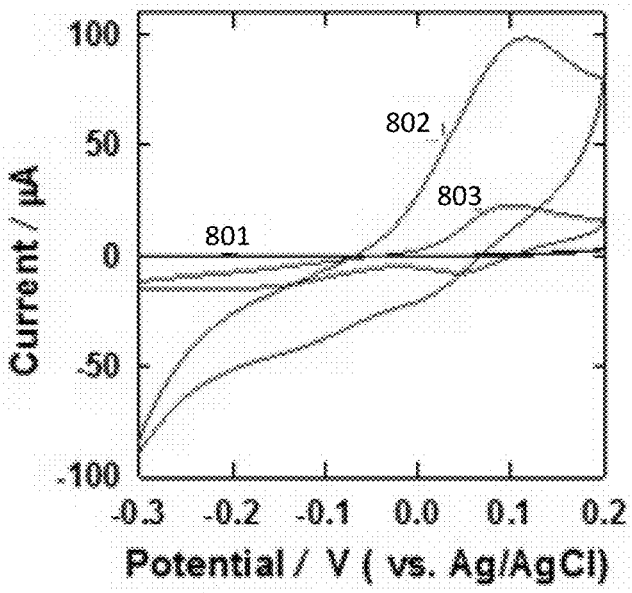
FIG. 8C is a cyclic voltammogram in 0.1 M KCl in the presence of 1 mM CT of the bare GZO electrode, for a GZO electrode with palladium nanoparticles, and for a palladium disk electrode

FIG. 8B and FIG. 8C show the CVs of hydroquinone (HQ) and catechol (CT) measured in 0.1 M KCl at the bare GZO electrode 801, PdNP-GZO electrode 802, and Pd disk electrodes 803. As with $H_2O_2$ oxidation, across the entire rage of potentials tested (−300 mV to +200 mV), the oxidations of HQ and CT were unsuccessful at the bare GZO electrode 801. Interestingly, PdNP-GZO electrode 802 showed a significantly higher oxidation current for HQ with an $E_{pa}$ at −20 mv. The oxidized products were successively reduced during the reverse scan, and $E_{pc}$ was measured to be −167 mV. The $\Delta E_p$ was 147 mV, i.e., the electrochemical reaction of HQ at PdNP-GZO electrode 802 was nearly reversible. The $E_{pa}$ and $E_{pc}$ of the electrochemical reactions of HQ at the Pd disk electrode 803 were found to be −5 mV and −83 mV, respectively, i.e. $\Delta E_p$ was 88 mV and was reversible. The peak $i_{pa}$ and $i_{pc}$ values in the CV of HQ at the Pd disk electrode 803 were significantly lower than those obtained at PdNP-GZO electrode 802.

The $E_{pa}$ of the CT at the PdNP-GZO electrode 802 and disk Pd electrode 803 appeared at +115 mV, and the oxidized products were reduced during successive reverse scans at either electrode surface. As with HQ, CT showed higher anodic and cathodic currents at PdNP-GZO electrode 802 compared with the values obtained at the Pd disk electrode 803.

The above discussion of the electrochemical experiments indicated that the PdNPs acted as suitable mediators for shuttling electrons between $H_2O_2$, HQ, or CT and GZO electrode, and they facilitated electrochemical current generation upon electron exchange with $H_2O_2$, HQ, or CT. The higher electrocatalytic currents measured during the redox reactions of the various analytes at PdNP-GZO electrode 802 compared to the currents obtained at the Pd disk electrode may have resulted from the higher surface area of PdNP-GZO electrode 802 compared to the Pd disk electrode 803. The values of $E_{pa}$ for HQ and CT at PdNP-GZO electrode 802 differed by 135 mV, indicating that simultaneous determinations of HQ and CT may be possible using PdNP-GZO electrode 802.

The invention claimed is:

1. An aqueous solution method for manufacturing a palladium doped metal oxide conducting electrode, comprising:

immersing a metal oxide conducting electrode into an aqueous solution comprising a tetracholoropalladate precursor salt to form the metal oxide conducting electrode having at least one surface coated with the tetracholoropalladate precursor salt;

immersing the metal oxide conducting electrode having at least one surface coated with the tetrachloropalladate precursor salt in an organic solution comprising a phase transfer catalyst and an aliphatic thiol or aromatic thiol; and reducing the metal oxide conducting electrode having at least one surface coated with tetracholoropalladate precursor salt with a borohydride compound to form the metal oxide conducting electrode having at least one surface coated with palladium nanoparticles;

wherein the palladium nanoparticles on the metal oxide conducting electrode have an average diameter of 8 nm to 22 nm and are present on the surface of the metal oxide conducting electrode at a density from $1.5\times10^{-3}$ $Pd\cdot nm^{-2}$ to $3.5\times10^{-3}$ $Pd\cdot nm^{-2}$.

2. The method of claim 1, wherein the metal oxide conducting electrode comprises gallium-doped zinc oxide or aluminum-doped zinc oxide.

3. The method of claim 1, wherein the tetracholoropalladate precursor salt is selected from the group consisting of potassium tetrachloropalladate (II) or sodium tetrachloropalladate (11).

4. The method of claim 1, wherein the aqueous solution comprising the tetracholoropalladate precursor salt has a pH of 2.5-5.

5. The method of claim 1, wherein the concentration of the tetracholoropalladate precursor salt in the aqueous solution is between 0.5 mM and 2 mM.

6. The method of claim 1, wherein the borohydride compound is selected from the group consisting of lithium triethylborohydride, lithium borohydride, and sodium borohydride.

7. The method of claim 1, wherein the surface coated with the tetracholoropalladate precursor salt is reduced with a solution of the borohydride compound having a concentration between 2 mM and 7 mM.

8. The method of claim 1, wherein the palladium nanoparticles coated on the surface of the metal oxide conducting electrode have a peak current of 70 μA to 130 μA when a voltage of 510 mV to 600 mV is applied in cyclic voltammetry analysis.

9. The method of claim 1, further comprising treating the palladium nanoparticles coated on the surface of the metal oxide conducting electrode with a strong Arrhenius base.

10. The method of claim 9, wherein the strong Arrhenius base is sodium hydroxide or potassium hydroxide.

11. The method of claim 10, wherein the palladium nanoparticles coated on the surface of the metal oxide conducting electrode are immersed in the sodium hydroxide or the potassium hydroxide solution having a concentration of 0.05 M-1.5 M.

12. The method of claim 1, wherein a thickness of the palladium nanoparticles coated on the surface of the metal oxide conducting electrode is 8 nm to 32 nm.

13. The method of claim 1, further comprising rinsing the tetracholoropalladate precursor salt coated on the surface of the metal oxide conducting electrode with water and drying after the immersing and prior to the reducing.

14. The method of claim 1, wherein the metal oxide conducting electrode is immersed for at least 1 hour into the aqueous solution comprising the tetracholoropalladate precursor salt.

15. The method of claim 1, wherein the electrocatalytic substrate oxidizes hydroquinone and catechol to benzoquinone at a peak cathodic potential of −0.2 Volts to −0.1 Volts, and a peak anodic potential of −0.05 Volts to 0.15 Volts in a 0.8-0.15 M solution of potassium chloride.

16. The method of claim 1, wherein the electrocatalytic substrate oxidizes hydrogen peroxide at a peak anodic potential of 0.3 V to 0.48 V in a 0.8-0.15 M solution of sodium hydroxide.

* * * * *